US010626333B2

(12) United States Patent
Maglente et al.

(10) Patent No.: US 10,626,333 B2
(45) Date of Patent: Apr. 21, 2020

(54) PROCESSES FOR SWEETENING A HYDROCARBON STREAM

(71) Applicant: UOP LLC, Des Plaines, IL (US)

(72) Inventors: July S. Maglente, Prairie Grove, IL (US); Luigi Laricchia, Arlington Heights, IL (US); Jonathan A. Tertel, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 13 days.

(21) Appl. No.: 15/196,243

(22) Filed: Jun. 29, 2016

(65) Prior Publication Data

US 2017/0009147 A1 Jan. 12, 2017

Related U.S. Application Data

(60) Provisional application No. 62/190,096, filed on Jul. 8, 2015.

(51) Int. Cl.
*C10G 19/00* (2006.01)
*C10G 19/08* (2006.01)

(52) U.S. Cl.
CPC ..... *C10G 19/08* (2013.01); *C10G 2300/202* (2013.01); *C10G 2300/4081* (2013.01)

(58) Field of Classification Search
CPC ..... C10G 19/08; C10G 2300/202; C10G 2300/4081
See application file for complete search history.

(56) References Cited

U.S. PATENT DOCUMENTS

| | | | | |
|---|---|---|---|---|
| 2,413,945 | A * | 1/1947 | Bolt | C10G 19/00 208/204 |
| 2,937,986 | A * | 5/1960 | Lukk | C10G 19/08 208/229 |
| 4,141,819 | A * | 2/1979 | Carlson | B01J 31/0217 208/206 |
| 2003/0072707 | A1 | 4/2003 | Ray et al. | |
| 2003/0085181 | A1* | 5/2003 | Greaney | C10G 19/02 210/749 |
| 2010/0122936 | A1* | 5/2010 | Tertel | C10G 19/08 208/208 R |
| 2012/0000826 | A1 | 1/2012 | Tertel | |
| 2013/0220888 | A1 | 8/2013 | Tertel et al. | |
| 2014/0197109 | A1 | 7/2014 | Laricchia et al. | |
| 2014/0202963 | A1 | 7/2014 | Laricchia et al. | |
| 2014/0235897 | A1 | 8/2014 | Tertel et al. | |
| 2015/0014255 | A1 | 1/2015 | Laricchia et al. | |

* cited by examiner

*Primary Examiner* — Prem C Singh
*Assistant Examiner* — Brandi M Doyle

(57) ABSTRACT

A process and apparatus for sweetening a hydrocarbon stream. The apparatus includes two vessels. In a first extraction vessel, caustic removes mercaptans from the hydrocarbon stream. In a second oxidation vessel, the mercaptans in the rich caustic are converted in disulfides. The lean caustic and disulfides are passed back to the first extraction vessel in which the disulfides are separated into the sweetened hydrocarbon phase. The second vessel may receive a wash oil, such as the sweetened hydrocarbon phase, to remove disulfides from a vented gas stream.

13 Claims, 3 Drawing Sheets

PROCESSES FOR SWEETENING A HYDROCARBON STREAM

CROSS-REFERENCE TO RELATED APPLICATION

This application claims priority from Provisional Application No. 62/190,096 filed Jul. 8, 2015, the contents of which are hereby incorporated by reference.

FIELD OF THE INVENTION

This invention relates generally to processes for sweetening hydrocarbon streams, and more particularly, to processes for treating caustic waste flow that results from the sweetening of the hydrocarbon streams.

BACKGROUND OF THE INVENTION

Crude oils predominantly contain hydrocarbons, with sulfur, nitrogen, oxygen, and metals being minor constituents. While it is desirable to recover the hydrocarbon constituents in their pure form, it is difficult to isolate pure products because most of the minor constituents occur in combination with carbon and hydrogen. Separation of impurities, such as those listed above, from the hydrocarbons generally consumes time, chemicals, energy, and money. Therefore, one goal of the petroleum processing industry is to optimize impurity-removal procedures, equipment, and resources in order to eliminate those impurities that have the most degrading effect on the end products.

A common impurity encountered in hydrocarbon processing is sulfur. The presence of sulfur in hydrocarbon products generally increases the corrosive characteristics thereof, and sulfur forms harmful and noxious reaction products upon combustion. Consequently, measures are taken to either reduce the amount of sulfur or to render the sulfur-containing compounds inoffensive. A common method for treating petroleum to reduce the degrading effects of sulfur is chemical processing to "sweeten" sulfur compounds contained in the particular fractions, e.g., mercaptans that are designated by the formula R—SH. "Sweetening" denotes that mercaptan sulfur compounds are converted to less objectionable disulfide compounds, e.g., R—S—S—R, R—S—S—R', etc. One particular process known in the art is the sweetening of petroleum products such as kerosene by the Merox process, which is available from UOP LLC of Des Plaines, Ill., USA.

In order to sweeten a petroleum product, a caustic solution, such as sodium hydroxide or potassium hydroxide, is generally first used to convert the mercaptan compounds to the ionic state, $RS^-$. The caustic solution is also helpful in that it removes naphthenic acids and other organic acids in general such as phenolic acids, and other sulfur compounds from refined petroleum products and petroleum distillate. Various processes for regenerating the caustic solutions and apparatus for same are disclosed in the prior art. For example, U.S. Pat. Nos. 8,597,501 and 7,326,333 disclose such exemplary processes and apparatus. While these processes and apparatuses are effective for their intended purposes, in some processes, it may not be necessary for a total reduction of sulfur compounds. More specifically, the presence of some sulfur compounds, such as disulfides in the sweetened hydrocarbon stream, may be acceptable for various refiners. Accordingly, some of the units and vessels associated with a caustic regeneration may be superfluous or unnecessary for some refiners.

Therefore, it would be desirable to have processes and systems which allow for the regeneration of a caustic solution without requiring all of the equipment typically associated with the processing of such streams. Furthermore, other desirable features and characteristics of the present disclosure will become apparent from the subsequent detailed description and the appended claims, taken in conjunction with the accompanying drawings and this background of the disclosure.

SUMMARY OF THE INVENTION

One or more processes have been invented for efficiently and effectively regenerating a caustic solution having mercaptans which utilizes less equipment compared to current designs.

Therefore, in a first embodiment of the invention, the present invention may be characterized broadly as providing a process for sweetening a hydrocarbon stream by: extracting mercaptans from a hydrocarbon stream with a caustic stream in an extraction zone to provide a sweetened hydrocarbon stream and a rich caustic stream; mixing a catalyst with the rich caustic stream; oxidizing the mercaptans in the rich caustic stream in an oxidation zone with an oxidation gas to provide a lean caustic stream; venting a spent air outlet stream from the oxidation zone, wherein the oxidation zone comprises a single vessel that provides the lean caustic stream and the spent air outlet stream; and recycling the lean caustic stream from the oxidation zone to the extraction zone.

In various embodiments of the present invention, the lean caustic stream includes disulfides. It is contemplated that the process includes removing the disulfides from the lean caustic stream in the extraction zone, wherein the sweetened hydrocarbon stream includes the disulfides.

In at least one embodiment of the present invention, the process includes introducing the oxidation gas to the rich caustic stream between the extraction zone and the vessel of the oxidation zone.

In one or more embodiments of the present invention, the process includes introducing the oxidation gas into the vessel of the oxidation zone at a first inlet, and introducing the rich caustic stream into the vessel of the oxidation zone at a second inlet. It is contemplated that the first inlet is disposed below the second inlet.

In some embodiments of the present invention, a flow of the rich caustic stream in the vessel of the oxidation zone is countercurrent to a flow of the oxidation gas in the vessel of the oxidation zone.

In many of the embodiments of the present invention, the process includes removing disulfides from the spent air outlet stream from the oxidation zone with a wash oil. It is contemplated that the wash oil comprises a portion of the sweetened hydrocarbon stream.

In a second aspect of the present invention, the present invention may be generally characterized as providing a process for sweetening a hydrocarbon stream by: passing a hydrocarbon stream to an extraction zone configured to remove mercaptans from the hydrocarbon stream with a caustic stream and to provide a sweetened hydrocarbon stream and a rich caustic stream; passing the rich caustic stream to an oxidation zone having an oxidation vessel configured to oxidize the mercaptans in the rich caustic stream and provide a lean caustic stream; passing a catalyst to the oxidation vessel; passing an oxidation gas to the oxidation vessel; passing the lean caustic stream to the extraction zone as the caustic stream; and, venting a spent air outlet stream from the oxidation vessel.

In one or more embodiments of the present invention, the rich caustic stream, the catalyst, and the oxidation gas are all combined and passed into the oxidation vessel together.

In various embodiments of the present invention, the process includes passing the oxidation gas into the oxidation vessel at a first inlet, and introducing the rich caustic stream into the oxidation vessel at a second inlet. It is contemplated that a flow of the rich caustic stream in the oxidation vessel is countercurrent to a flow of the oxidation gas in the oxidation vessel.

In some embodiments of the present invention, the process includes removing disulfides from the spent air outlet stream from the oxidation vessel with a wash oil. It is contemplated that the process includes recovering a rich wash oil from the oxidation vessel and recycling at least a portion of the rich wash oil as the wash oil. It is further contemplated that the wash oil comprises the sweetened hydrocarbon stream. It is further contemplated that the rich wash oil is combined with the sweetened hydrocarbon stream.

In all of the embodiments of the present invention, the sweetened hydrocarbon stream includes disulfides.

In a third aspect of the present invention, the present invention may be broadly characterized as providing a vessel for a caustic regeneration in a hydrocarbon purification process. The vessel may include an inlet disposed in the vessel between a top of the vessel and a bottom of the vessel and configured to receive a rich caustic stream, a mixing zone disposed in the vessel configured to mix the rich caustic stream and an oxidation gas to oxidize mercaptans in the rich caustic stream to disulfides, a gaseous outlet disposed proximate the top of the vessel and configured to provide a spent air outlet stream, a coalescer disposed between the gaseous outlet and the mixing zone, and, an outlet for a lean caustic stream disposed proximate the bottom of the vessel.

In various embodiments of the present invention, the vessel also includes a second mixing zone disposed above the first mixing zone and being separated from the first mixing zone with a liquid collection tray configured to allow vapors to pass upward there through and prevent liquids from passing downward there through. The vessel may further include an inlet associated with the second mixing zone for a wash oil, and an outlet associated with the liquid collection tray for a rich wash oil.

Additional aspects, embodiments, and details of the invention, all of which may be combinable in any manner, are set forth in the following detailed description of the invention.

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. In addition, the term "stream" may be applicable to other fluids, such as aqueous and non-aqueous solutions of alkaline or basic compounds, such as sodium hydroxide.

Moreover, hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., C3+ or C3−, which is inclusive of the abbreviated one or more hydrocarbons. As an example, the abbreviation "C3+" means one or more hydrocarbon molecules of three carbon atoms and/or more.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "alkali" can mean any substance or material that in solution, typically a water solution, has a pH value greater than about 7.0, and exemplary alkali can include sodium hydroxide, potassium hydroxide, or ammonia. Such an alkali in solution may be referred to as an alkaline solution or an alkaline.

As used herein, the term "phase" may mean a liquid, a gas, or a suspension including a liquid and/or a gas, such as a foam, aerosol, or fog. A phase may include solid particles. Generally, a fluid can include one or more gas, liquid, and/or suspension phases.

As used herein, the term "parts per million" may be abbreviated herein as "ppm" and "weight ppm" may be abbreviated herein as "wppm".

As used herein, the term "mercaptan" typically means thiol and may be used interchangeably therewith, and can include compounds of the formula RSH as well as salts thereof, such as mercaptides of the formula RS-M+ where R is a hydrocarbon group, such as an alkyl or aryl group, that is saturated or unsaturated and optionally substituted, and M is a metal, such as sodium or potassium.

As used herein, the term "disulfides" can include dimethyldisulfide, diethyldisulfide, and ethylmethyldisulfide, and possibly other species having the molecular formula RSSR' where R and R' are each, independently, a hydrocarbon group, such as an alkyl or aryl group, that is saturated or unsaturated and optionally substituted.

Typically, a disulfide is generated from the oxidation of a mercaptan-containing caustic and forms a separate hydrocarbon phase that is not soluble in the aqueous caustic phase. Generally, the term "disulfides" as used herein excludes carbon disulfide (CS2).

As depicted, process flow lines in the figures can be referred to, interchangeably, as, e.g., lines, pipes, branches, distributors, streams, effluents, feeds, products, portions, catalysts, withdrawals, recycles, suctions, discharges, and caustics.

DETAILED DESCRIPTION OF THE DRAWINGS

One or more exemplary embodiments of the present invention will be described below in conjunction with the following drawing figures, in which.

DETAILED DESCRIPTION OF THE INVENTION

As mentioned above, various processes have been invented for efficiently and effectively regenerating a caustic solution having mercaptans which utilizes less equipment compared to conventional designs. By utilizing less equipment, there is a savings in plot space, as well as capital costs and operating expenses.

With these general principles in mind, one or more embodiments of the present invention will be described with the understanding that the following description is not intended to be limiting.

Figure 1:
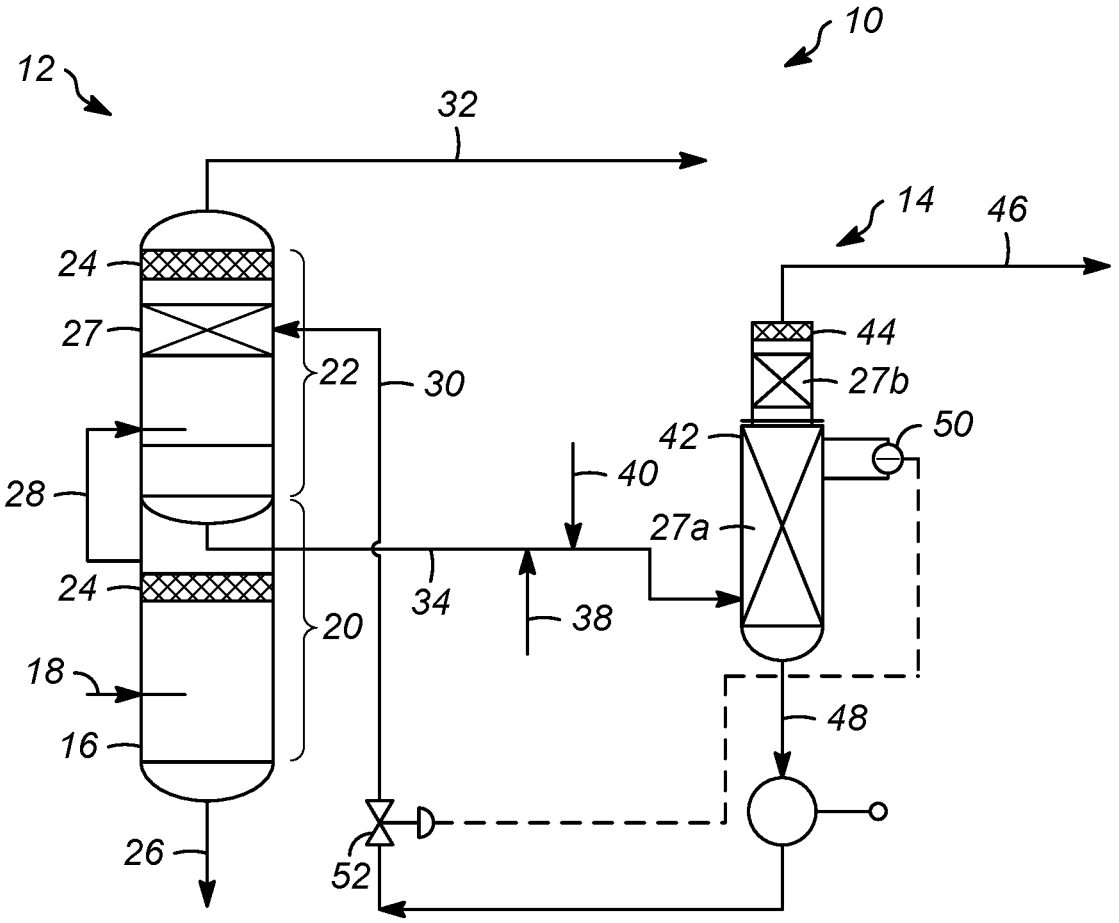
FIG. 1 shows a schematic diagram of an apparatus in accordance with various embodiments of the present invention.

As shown in FIG. 1, an exemplary apparatus 10 is shown which includes an extraction zone 12 and an oxidation zone 14. The extraction zone 12 typically comprises an extractor vessel 16 which receives a hydrocarbon stream 18, which is typically in a liquid phase and can include a fuel gas stream, a liquefied petroleum gas, or a naphtha hydrocarbon. Often, the hydrocarbon stream 18 also comprises sulfur compounds in the form of one or more mercaptans and/or hydrogen sulfide. A hydrocarbon stream 18 can be an effluent from another refinery unit, e.g., an amine absorber. The hydrocarbon stream 18 can include hydrogen sulfide and one or more C2 to C8 hydrocarbons. Usually, the hydrocarbon stream 18 can include up to about 100 ppm, by weight, hydrogen sulfide.

In an exemplary embodiment, the extractor vessel 16 can include a lower pre-wash section 20, and an upper extractor section 22. The hydrocarbon stream 18 may be combined with a stream including water (not shown) and, further combined with a caustic stream (discussed below) for removing sulfur compounds, e.g., hydrogen sulfide. The addition of the caustic and removal of same is known in the art, and is shown in U.S. Pat. No. 6,749,741. The caustic can be any alkaline material, and generally includes caustic soda (NaOH) and caustic alcohol ($C_2H_3ONa$). The hydrocarbon stream 18 can enter the extractor vessel 16 preferably via the lower prewash section 20.

The lower prewash section 20 can include a coalescer 24 to improve the separation between the hydrocarbon phase and the aqueous or caustic phases, which can be any suitable packing, such as a mesh blanket or the like. Typically, the coalescer 24 can be any suitable dimension, but is typically about 10 to about 60 cm (about 4 to 24 inches) in length. The coalescer 24 can be made from any suitable material, including carbon steel, stainless steel, or carbon.

Within the lower prewash section 20 of the extractor vessel 16, a predominately hydrocarbon phase can rise while the caustic can fall. A spent caustic stream can be withdrawn from the lower prewash section 20 of the extractor vessel 16 in line 26 and, at least a portion thereof can be combined with the hydrocarbon stream 18, as mentioned above.

The upper section 22 of the extractor vessel 16 will receive the hydrocarbon phase from the lower prewash section 22 of the extractor vessel 16. For example a transfer conduit 28 can be utilized will allows for the hydrocarbon phase to pass to the upper section 22 of the extractor vessel 16. In addition to the hydrocarbon phase, the upper section 22 of the extractor vessel 16 will receive a caustic stream 30. Similar to the lower prewash section 20, in the upper section 22 of the extractor vessel 16, the caustic will remove sulfur compounds from the hydrocarbon phase and a hydrocarbon product stream 32 mostly free of mercaptans can be withdrawn from the upper section 22 of the extractor vessel 16. In order to increase the contact between the caustic and hydrocarbons, the upper section, may include a packing element 27. One exemplary packing element 27 is ring packing, such as RASCHIG packing material sold by Raschig GmbH LLC of Ludwigshafen, Germany. Other types of packing element 27 can include structured packing, fiber and/or film contactors, or tray systems, e.g. one or more trays, as long as suitable contact is attained. The upper section 22 of the extractor vessel 16 may also include a coalescer 24, discussed above, to increase separation between the hydrocarbon and aqueous (caustic) phases. The hydrocarbon product stream 32, which comprises a sweetened hydrocarbon product, can be processed further as is known in the art.

A rich caustic stream 34 including mercaptans can be withdrawn from the extractor vessel 16. The rich caustic stream 34 can be combined with an oxidation catalyst 38 and an oxidation gas stream 40. The oxidation catalyst 38 can be any suitable oxidation catalyst, such as a sulfonated metal phthalocyanine or those described in, e.g., U.S. Pat. No. 7,326,333. The oxidation gas stream 40 preferably comprises air. The oxidation catalyst 38, oxidation gas stream 40, and the rich caustic stream 34 can be combined before entering the oxidation zone 14.

The oxidation zone 14 includes an oxidation vessel 42, which in this embodiment, receives a stream in which the oxidation catalyst 38, oxidation gas stream 40, and the rich caustic stream 34 have been combined. As will be discussed below, other configurations are contemplated.

In the oxidation vessel 42, the mercaptans catalytically react with oxygen and water to produce caustic and organic disulfides. The oxidation vessel 42 may include also include packing, such packing elements 27*a*, 27*b*, similar to the packing element 27 discussed above, to increase the surface area for improving contact between the spent caustic and oxidation catalyst and or to increase the mixing and contact between rising vapors and falling liquid in an upper portion of the oxidation vessel 42. Inside of the oxidation vessel 42 a gas phase, a liquid disulfide phase, and a liquid aqueous caustic phase can co-exist. Generally, the gas phase includes air with at least some oxygen depletion. In the gas phase, the oxygen content can be about 5 to about 21%, by mole. Generally, the oxidation vessel 42 will operate with a temperature between about 32 to about 54° C. (90 to 130° F.), with in inlet temperature of typically between about 41 to 46° C. (105 to 115° F.). The pressure in the oxidation vessel 42 may be between about 241 to 483 kPag (35 to 70 psig), typically about 379 kPag (55 psig).

At the top of the oxidation vessel 42 may be a demister 44 which can be any suitable demister for removing liquid particles from a rising gas. Generally, the demister 44 can be a mesh or vane demister, preferably a mesh demister. A spent air outlet stream 46 comprising the gas phase may be vented from the oxidation vessel 42. The spent air outlet stream 46 can be, with or without being blended with fuel gas, used as a fuel in a heater or furnace.

A lean caustic stream 48 may be withdrawn from the oxidation zone 14. The lean caustic stream 48 may also include disulfides produced within the oxidation zone 14 and unlike prior processes, instead of separating the disulfides from the caustic in the lean caustic stream 48, the lean caustic stream 48 is passed back or recycled directly to the extraction zone 12, as the caustic stream 30 passed into the upper section 22 of the extraction zone 12. A level indicator 50 in the oxidation vessel 42 may be in communication with a valve 52 so as to control a flow of the lean caustic stream 48.

Within the extraction zone 12, the disulfides will be absorbed into the hydrocarbon phase and withdrawn from the extractor vessel 16 in the hydrocarbon product stream 32. Thus, the extraction zone 12 is used as a separation zone to separate the disulfides from the caustic.

Figure 2:
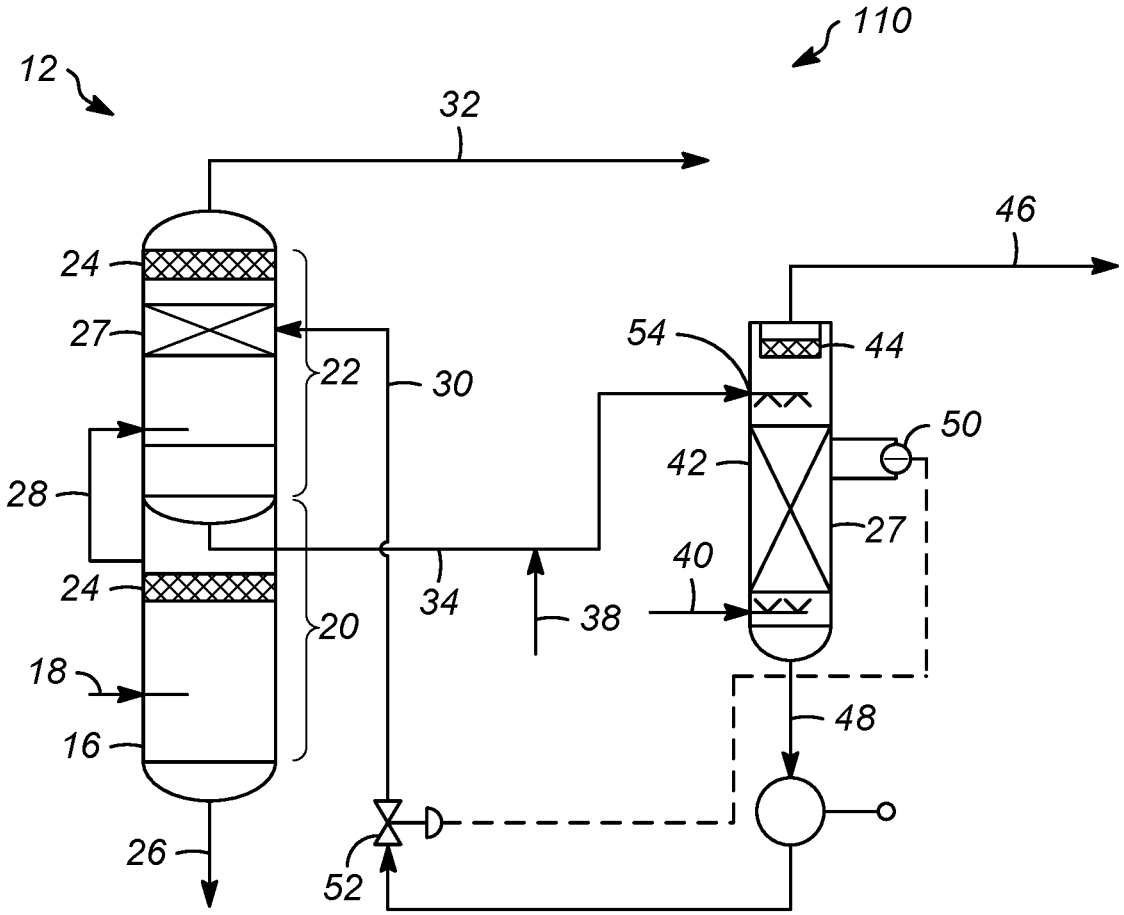
FIG. 2 shows another schematic diagram of an apparatus in accordance with various embodiments of the present invention; and, FIG. 3 shows yet another schematic diagram of an apparatus in accordance with various embodiments of the present invention.

Turning to FIG. 2, another embodiment of the present invention is shown in which like elements are denoted by identical reference numbers. In this depicted apparatus 110 of the present invention, in order to improve the mixing between the oxidation gas 40 and the rich caustic 34, the catalyst 38 and the rich caustic 34 are combined and introduced into the oxidation vessel at a first injection point 54, while the oxidation gas 40 air is introduced into the oxidation vessel 42 at a second injection point 56.

Preferably, the first injection point 54 (for the rich caustic stream 34 and the catalyst stream 38), is at a higher point on the oxidation vessel 42 compared to the second injection point 56 (for the oxidation gas 40). This will create a countercurrent flow between the rich caustic stream 34 and the oxidation gas 40 within the oxidation vessel 42. As will be appreciated any suitable distributor may be used to introduce the different streams into the oxidation vessel 42. Preferably, a packing element 27 is disposed between the two injection points 54, 56. In contrast to the FIG. 1 which shows two packing elements 27*a*, 27*b*, in the oxidation vessel 42 of FIG. 2, only one packing element 27 is depicted. The remaining portions of this embodiment are the same as described above, and thus those portions of the above description are hereby incorporated herein.

Figure 3:
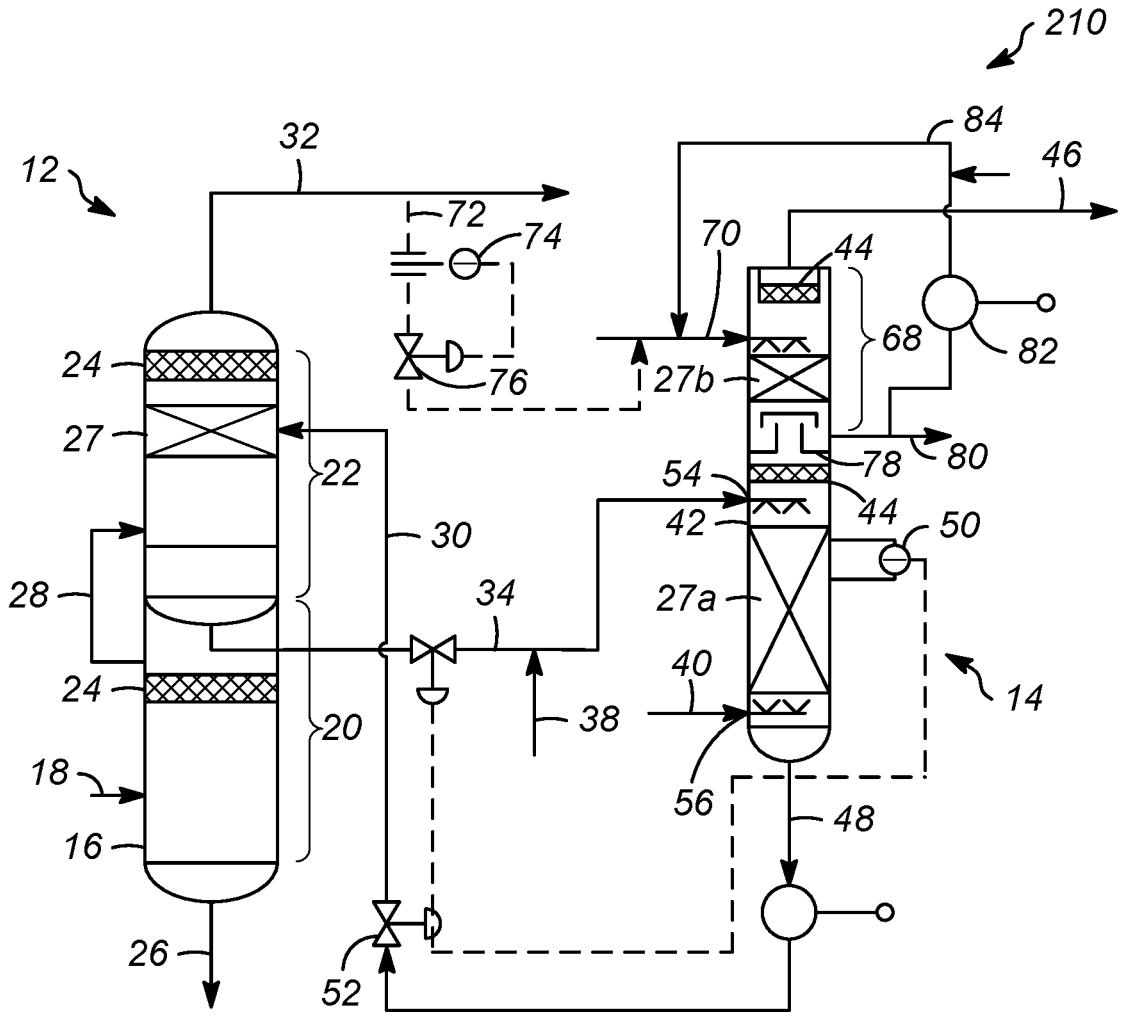

Turning to FIG. 3, another embodiment of the present invention is shown in which like elements are denoted by identical reference numbers. In this depicted apparatus 210 of the present invention, a wash oil is utilized to remove any disulfides from the spent air outlet stream 46 that is to be vented from the oxidation zone 14.

As shown in FIG. 3, the oxidation vessel 42 includes an upper washing section 68 which receives a wash oil stream 70. The wash oil 70 may comprise, for example, a hydrotreated heavy naphtha or kerosene. It is further contemplated that the wash oil 70 comprises a portion of the sweetened hydrocarbon product stream 32, for example from a slip stream 72 (shown in dashed lines). If a slip stream 72 is used, the flow of the product can be controlled via an indicator 74 and valve 76.

The wash oil 70 is injected into the washing section 68 of the oxidation vessel 42, preferably, in a downward flowing manner Most preferably the injection occurs above a packing element 27*b*, for increased contact between the rising vapors and the falling wash oil. The falling wash oil will remove mercaptans that are contained within the rising vapors of the oxidation vessel 42. Thus, the use of the wash oil 70 will further lower the sulfur level in the spent air outlet stream 46 vented from the oxidation vessel 42.

A separation device 78, may be used to separate the upper washing section 68 from the remainder of the oxidation vessel 42. The separation device, such as a chimney tray, will allow vapors within the oxidation vessel 42 to pass upward there through but will preclude liquids from the washing section 68 from passing downwards there through. The separation device 78 may also be used to collect rich wash oil within the washing section 68 of the oxidation vessel 42. A rich wash oil stream 80 may be withdrawn from the oxidation vessel 42. All, or a portion, of the rich wash oil 80 may be recycled and re-used as the wash oil 70 via a pump 82 and a recycle line 84. Alternatively, for example, if the wash oil 70 comprises the sweetened hydrocarbon product stream 32, the rich wash oil 80 may be combined with the product hydrocarbon stream 32 and processed further as is known in the art.

In any of the foregoing embodiments, the necessary equipment for regenerating a caustic has been combined. As will be appreciated, this will allow for the use of smaller caustic regeneration sections that require less space and which cost less to both install and operate. Furthermore, the separate introduction of the air and the caustic/catalyst in the oxidation vessel will increase the mixing between the two. Additionally, the use of the wash oil can be used to ensure that the sulfur level of the air from the oxidation vessel is at an acceptable air. Finally, using the sweetened hydrocarbon product stream as the wash oil may lower operating costs as a separate wash oil need not be required.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

Specific Embodiments

While the following is described in conjunction with specific embodiments, it will be understood that this description is intended to illustrate and not limit the scope of the preceding description and the appended claims.

A first embodiment of the invention is a process for sweetening a hydrocarbon stream, the process comprising extracting mercaptans from a hydrocarbon stream with a caustic stream in an extraction zone to provide a sweetened hydrocarbon stream and a rich caustic stream; mixing a catalyst with the rich caustic stream; oxidizing the mercaptans in the rich caustic stream in an oxidation zone with an oxidation gas to provide a lean caustic stream; venting a spent air outlet stream from the oxidation zone, wherein the oxidation zone comprises a single vessel that provides the lean caustic stream and the spent air outlet stream; and, recycling the lean caustic stream from the oxidation zone to the extraction zone. An embodiment of the invention is one, any or all of prior embodiments in this paragraph up through the first embodiment in this paragraph wherein the lean caustic stream includes disulfides. An embodiment of the invention is one, any or all of prior embodiments in this paragraph up through the first embodiment in this paragraph further comprising removing the disulfides from the lean caustic stream in the extraction zone, wherein the sweetened hydrocarbon stream includes the disulfides. An embodiment of the invention is one, any or all of prior embodiments in this paragraph up through the first embodiment in this paragraph further comprising introducing the oxidation gas to the rich caustic stream between the extraction zone and the vessel of the oxidation zone. An embodiment of the invention is one, any or all of prior embodiments in this paragraph up through the first embodiment in this paragraph further comprising introducing the oxidation gas into the vessel of the oxidation zone at a first inlet; and, introducing the rich caustic stream into the vessel of the oxidation zone at a second inlet. An embodiment of the invention is one, any or all of prior embodiments in this paragraph up through the first embodiment in this paragraph wherein the first inlet is disposed below the second inlet. An embodiment of the invention is one, any or all of prior embodiments in this paragraph up through the first embodiment in this paragraph wherein a flow of the rich caustic stream in the vessel of the oxidation zone is countercurrent to a flow of the oxidation gas in the vessel of the oxidation zone. An embodiment of the invention is one, any or all of prior embodiments in this paragraph up through the first embodiment in this paragraph further comprising removing disulfides from the spent air outlet stream from the oxidation zone with a wash oil. An embodiment of the invention is one, any or all of prior embodiments in this paragraph up through the first embodiment in this paragraph wherein the wash oil comprises a portion of the sweetened hydrocarbon stream.

A second embodiment of the invention is a process for sweetening a hydrocarbon stream, the process comprising passing a hydrocarbon stream to an extraction zone configured to remove mercaptans from the hydrocarbon stream with a caustic stream and to provide a sweetened hydrocarbon stream and a rich caustic stream; passing the rich caustic stream to an oxidation zone having an oxidation vessel configured to oxidize the mercaptans in the rich caustic stream and provide a lean caustic stream; passing a catalyst to the oxidation vessel; passing an oxidation gas to the oxidation vessel; passing the lean caustic stream to the extraction zone as the caustic stream; and, venting an spent air outlet stream from the oxidation vessel. An embodiment of the invention is one, any or all of prior embodiments in this paragraph up through the second embodiment in this paragraph wherein the rich caustic stream, the catalyst, and the oxidation gas are all combined and passed into the oxidation vessel together. An embodiment of the invention is one, any or all of prior embodiments in this paragraph up through the second embodiment in this paragraph further comprising passing the oxidation gas into the oxidation vessel at a first inlet; and, introducing the rich caustic stream into the oxidation vessel at a second inlet. An embodiment of the invention is one, any or all of prior embodiments in this paragraph up through the second embodiment in this paragraph wherein a flow of the rich caustic stream in the oxidation vessel is countercurrent to a flow of the oxidation gas in the oxidation vessel. An embodiment of the invention is one, any or all of prior embodiments in this paragraph up through the second embodiment in this paragraph further comprising removing disulfides from the spent air outlet stream from the oxidation vessel with a wash oil. An embodiment of the invention is one, any or all of prior embodiments in this paragraph up through the second embodiment in this paragraph further comprising recovering a rich wash oil from the oxidation vessel; and, recycling at least a portion of the rich wash oil as the wash oil. An embodiment of the invention is one, any or all of prior embodiments in this paragraph up through the second embodiment in this paragraph wherein the wash oil comprises the sweetened hydrocarbon stream. An embodiment of the invention is one, any or all of prior embodiments in this paragraph up through the second embodiment in this paragraph wherein the rich wash oil is combined with the sweetened hydrocarbon stream. An embodiment of the invention is one, any or all of prior embodiments in this paragraph up through the second embodiment in this paragraph wherein the sweetened hydrocarbon stream includes disulfides.

A third embodiment of the invention is a vessel for a caustic regeneration in a hydrocarbon purification process, the vessel comprising an inlet disposed in the vessel between a top of the vessel and a bottom of the vessel and configured to receive a rich caustic stream; a mixing zone disposed in the vessel configured to mix the rich caustic stream and an oxidation gas to oxidize mercaptans in the rich caustic stream to disulfides; a gaseous outlet disposed proximate the top of the vessel and configured to provide an spent air outlet stream; a coalescer disposed between the gaseous outlet and the mixing zone; and, an outlet for a lean caustic stream disposed proximate the bottom of the vessel. An embodiment of the invention is one, any or all of prior embodiments in this paragraph up through the third embodiment in this paragraph further comprising a second mixing zone disposed above the first mixing zone and being separated from the first mixing zone with a liquid collection tray configured to allow vapors to pass upward there through and prevent liquids from passing downward there through; an inlet associated with the second mixing zone for a wash oil; and, an outlet associated with the liquid collection tray for a rich wash oil.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for sweetening a hydrocarbon stream, the process comprising:

extracting mercaptans from a hydrocarbon stream with a caustic stream in an extraction zone to provide a sweetened hydrocarbon stream and a rich caustic stream;

mixing a catalyst with the rich caustic stream;

oxidizing the mercaptans in the rich caustic stream in an oxidation zone with an oxidation gas to form disulfides and provide a lean caustic stream;

venting a spent air outlet stream from the oxidation zone, wherein the oxidation zone comprises a single vessel and that single vessel provides the lean caustic stream and the spent air outlet stream;

introducing the oxidation gas into the vessel of the oxidation zone at a first inlet; and introducing the rich caustic stream into the vessel of the oxidation zone at a second inlet, wherein the first inlet is disposed below the second inlet;

recycling the lean caustic stream, with disulfides, from the oxidation zone to the extraction zone as the caustic stream; and, separating disulfides from the lean caustic stream with the hydrocarbon stream in the extraction zone such that extracted disulfides are within the sweetened hydrocarbon stream.

2. The process of claim 1 further comprising:

introducing the oxidation gas to the rich caustic stream between the extraction zone and the vessel of the oxidation zone.

3. The process of claim 1 wherein a flow of the rich caustic stream in the vessel of the oxidation zone is countercurrent to a flow of the oxidation gas in the vessel of the oxidation zone.

4. The process of claim 1 further comprising:

removing disulfides from the spent air outlet stream from the oxidation zone with a wash oil.

5. The process of claim 4 wherein the wash oil comprises a portion of the sweetened hydrocarbon stream.

6. A process for sweetening a hydrocarbon stream, the process comprising:

passing a hydrocarbon stream to an extraction zone configured to remove mercaptans from the hydrocarbon stream with a caustic stream and to provide a sweetened hydrocarbon stream and a rich caustic stream;

passing the rich caustic stream to an oxidation zone having an oxidation vessel configured to oxidize the mercaptans in the rich caustic stream and form disulfides and provide a lean caustic stream;

passing a catalyst to the oxidation vessel;

passing an oxidation gas to the oxidation vessel;

passing the lean caustic stream, with the disulfides, from the oxidation zone to the extraction zone as the caustic stream;

and, venting a spent air outlet stream from the oxidation vessel, wherein the sweetened hydrocarbon stream includes disulfides.

7. The process of claim 6 wherein the rich caustic stream, the catalyst, and the oxidation gas are all combined and passed into the oxidation vessel together.

8. The process of claim 6 further comprising:

passing the oxidation gas into the oxidation vessel at a first inlet; and, introducing the rich caustic stream into the oxidation vessel at a second inlet.

9. The process of claim 8 wherein a flow of the rich caustic stream in the oxidation vessel is countercurrent to a flow of the oxidation gas in the oxidation vessel.

10. The process of claim 6 further comprising:

removing disulfides from the spent air outlet stream from the oxidation vessel with a wash oil.

11. The process of claim 10 further comprising:

recovering a rich wash oil from the oxidation vessel; and, recycling at least a portion of the rich wash oil as the wash oil.

12. The process of claim 10 wherein the wash oil comprises the sweetened hydrocarbon stream.

13. The process of claim 12 wherein the rich wash oil is combined with the sweetened hydrocarbon stream.

* * * * *